US005767485A

United States Patent [19]

Kumada

[11] Patent Number: 5,767,485

[45] Date of Patent: Jun. 16, 1998

[54] SHEATHED HEATER WITH A SERIES-CONNECTED CURRENT REGULATING RESISTOR COMPRISED OF COBALT-COPPER ALLOY

[75] Inventor: Chiaki Kumada, Nagoya, Japan

[73] Assignee: NGK Spark Plug Co., Ltd., Nagoya, Japan

[21] Appl. No.: 704,101

[22] Filed: Aug. 28, 1996

[30] Foreign Application Priority Data

Dec. 28, 1995 [JP] Japan ..... 7-342703

[51] Int. Cl.[6] ..... F23Q 7/00

[52] U.S. Cl. ..... 219/270; 219/544; 219/505; 338/22 R; 420/435

[58] Field of Search ..... 219/260–270, 219/544, 553, 505; 338/22 R, 267; 420/435

[56] References Cited

U.S. PATENT DOCUMENTS

| | | | |
|---|---|---|---|
| 2,294,756 | 9/1942 | Inutsuka et al. | 338/22 R |
| 3,444,501 | 5/1969 | Delaney et al. | 338/22 R |
| 4,345,555 | 8/1982 | Oshima et al. | 123/272 |
| 4,423,309 | 12/1983 | Murphy et al. | 219/270 |
| 5,091,631 | 2/1992 | Dupuis et al. | 219/270 |
| 5,093,555 | 3/1992 | Dupuis et al. | 219/270 |
| 5,118,921 | 6/1992 | Aota | 219/270 |
| 5,132,516 | 7/1992 | Hatanaka et al. | 219/270 |
| 5,206,483 | 4/1993 | Aota | 219/270 |
| 5,319,180 | 6/1994 | Locher et al. | 219/270 |

FOREIGN PATENT DOCUMENTS

| | | | |
|---|---|---|---|
| 355 431 | 7/1989 | European Pat. Off. . | |
| 57-115622 | 7/1982 | Japan | 219/270 |

*Primary Examiner*—John A. Jeffery
*Attorney, Agent, or Firm*—Sughrue, Mion, Zinn, Macpeak & Seas, PLLC

[57] ABSTRACT

A sheathed heater comprises a heater disposed in a sheath tube by way of an insulation powder and is connected in series with a heat resistor and a current regulation resistor. The current regulation resistor is made from a cobalt-copper alloy which contains a copper component in the range from 1.0% to 14% by weight.

9 Claims, 4 Drawing Sheets

SHEATHED HEATER WITH A SERIES-CONNECTED CURRENT REGULATING RESISTOR COMPRISED OF COBALT-COPPER ALLOY

BACKGROUND OF THE INVENTION

1. Field of the Invention

This invention relates to a sheathed heater and a temperature self-regulating type glow plug which is disposed in a combustion chamber of an internal combustion engine such as diesel engine so as to help start the engine.

2. Description of the Prior Art

Upon starting an engine swiftly, it is desirable to arrange a preheating time period as short as possible. In order to realize this swiftness, a quick heating type glow plug has been introduced in which a large magnitude of current is provided with the glow plug to instantly rise a temperature of an outer surface of a sheathed heater while preventing a disconnection of a heater due to an excessive amount of heat production. This type of temperature self-regulating glow plug serves as a two-piece heater having a heat resistor connected in series with a current regulation resistor which has a greater positive temperature coefficient characteristic of a relation between resistance and temperature.

In general, the temperature self-regulating glow plug has a sheathed heater which provides a heat-resistant sheathed tube whose front end is closed to enclose a heater having a heating resistor connected in series with a current regulation resistor each in the form of helix. Within the sheathed tube, an insulation powder (e.g., ceramic powder) is provided to firmly support the sheathed heater. The sheathed heater is disposed in a front end of a cylindrical metallic shell to protract its length dimension forward. The heating resistor of the sheathed heater is usually made of iron-chromium alloy, and the current regulation resistor made of nickel-plated iron or cobalt-iron alloy, each of which has a higher temperature coefficient.

While the temperature coefficient of the nickel-plated iron, it is insufficiently short on oxidation resistant property, and its temperature coefficient deteriorates especially when the temperature reaches 700° C. or more. When adopting the cobalt-iron alloy, it becomes short on weld-intense property against the heating resistor although the cobalt-iron alloy maintains its great temperature coefficient even in a high temperature environment.

Therefore, it is one of the objects of the invention to provide a sheathed heater and a temperature self-regulating type glow plug which has a current regulation resistor superior in oxidation resistant property, weld-intense property and temperature coefficient even in a high temperature environment.

SUMMARY OF THE INVENTION

According to the present invention, there is provided a sheathed heater comprising: a heater disposed in a sheath tube to be connected in series with a heat resistor and a current regulation resistor; an insulation powder loaded with the sheath tube to firmly support the heater; the current regulation resistor being made from a cobalt-copper alloy which contains a copper component in the range from 1.0% to 14% by weight.

According to one aspect of the present invention, there is provided a temperature self-regulating type glow plug in which the sheathed heater is incorporated into a front end of a metallic shell having a male thread to be mounted on a cylinder head of an internal combustion engine. It is to be observed that the heating resistor and the current regulation resistor are each in the form of helix, and these resistors are welded upon connecting in series with each other. By series connecting a low value resistor between the heating resistor and the current regulation resistor in order to control heat transmission, it is possible to instantly rise the temperature of the heating resistor so as to maintain it approximately at 800° C. during an after-glow period upon starting the engine.

With the current regulation resistor made of the cobalt-copper based alloy which contains a copper component in the range from 1.0% to 14% by weight, it represents a superior oxidation resistant property, and exhibiting a good weld-intense property against the iron-chromium based alloy which is adopted as the heating resistor. Additionally, it represents a disconnection resistant property in spite of repeated on-off actuation while maintaining a temperature coefficient nearly twelve times higher than a room temperature in such a severe environment as 900° C. or more.

The copper component of the current regulation resistor is determined to be more than 1.0% by weight because an addition of 1.0% copper component changes a close-packed hexagonal lattice structure of pure cobalt to a face-centered cubic lattice structure which is deformable to be readily machined.

The copper component of the current regulation resistor is determined to be less than 14% by weight because its liquid phase line keeps above 1400° C. to satisfactorily compensate an upper limit of the operating temperature of the temperature self-regulating type glow plug.

BRIEF DESCRIPTION OF THE DRAWINGS

These and other objects, aspect and embodiments of the invention will be described in more detail with reference to the following drawing figures, of which.

DETAILED DESCRIPTION OF PREFERRED EMBODIMENTS OF THE INVENTION

Figure 1:
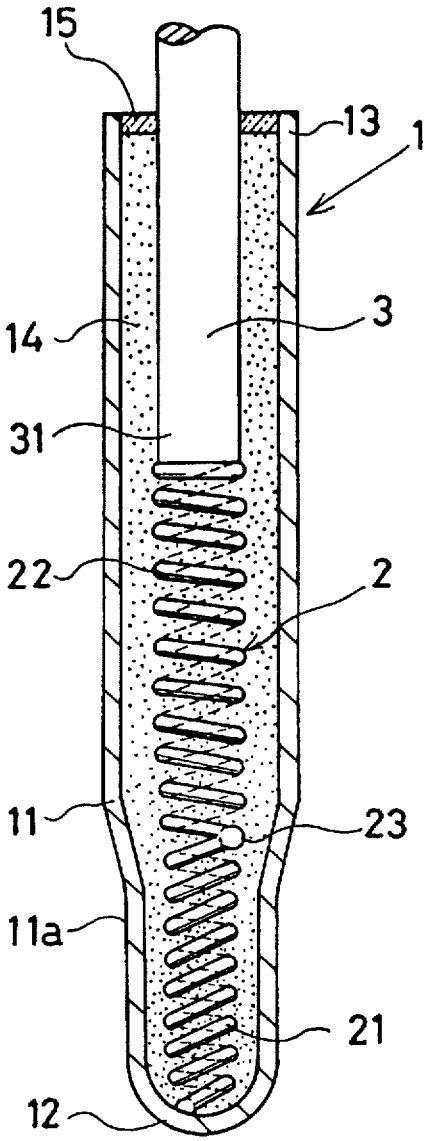
FIG. 1 is a longitudinal cross sectional view of a sheathed heater according to a first embodiment of the invention.

Referring to FIG. 1 which shows a sheathed heater 1 according to a first embodiment of the invention. The sheathed heater 1 has a heater 2 disposed in a sheathed tube 11 made of a heat resistant metal such as e.g., stainless steel. The sheathed tube 11 has an open rear end 13 and a front close end 12 having a semi-spherical configuration. Within the sheathed tube 11, an electrical insulation powder (e.g., ceramic powder) 14 is supplied to firmly support the heater 2.

Through the rear end 13 of the sheathed tube 11, a center electrode 3 is inserted coaxially to the sheathed tube 11. The heater 2 electrically connects a front end 31 of the center electrode 3 to an inner wall of the front end 12 of the sheathed tube 11 by way of a heat resistor 21 and a current regulation resistor 22. To the open rear end 13 of the sheathed tube 11 is filled with silicon based seal 15 so as to prevent an entry of foreign matters such as liquid and oil ingredients.

The heat resistor 21 and the current regulation resistor 22 are each in the form of helix, and the resistors 21, 22 are connected in series with each other to form the heater 2 by means of a welding. The heat resistor 21 is made of an iron-chromium alloy whose front end is arc welded the inner wall of the front end 12 of the sheathed tube 11. The rear end of the heat resistor 21 is arc welded to a front end of the current regulation resistor 22 as designated by numeral 23. The current regulation resistor 22 is made of a cobalt-copper alloy whose front end is welded to the rear end of the heat resistor 21, and the rear end of the current regulation resistor 22 is welded to the front end 31 of the center electrode 3.

The current regulation resistor 22 is made of a cobalt-copper alloy wire which contains a copper component in the range of 1.0% to 14% by weight. With an addition of the copper component by 1.0% or more by weight, a pure cobalt of a hexagonal lattice structure changes to a face-centered cubic lattice structure which is deformable to be readily machined into a helical shape configuration. The liquid phase line, in which the resistor 22 contains the copper component by 14% by weight so as to rapidly deteriorate its strength, corresponds to around 1400° C., and the liquid phase line increases with the decrease of the copper component. So long as the operating temperature of the sheathed heater and the self-regulating glow plug reaches its upper limit of 1400° C. or more, all the operating condition is satisfied.

It is to be noted that the copper component may preferably in the range of 3.0% to 12% by weight. The current regulation resistor 22 adopts the cobalt-copper alloy wire because its temperature coefficient is maintained higher even in such a high temperature environment as 700° C. or more while keeping a good weld-intense property against the iron-chromium alloy and the nickel-chromium alloy. In comparison to an cobalt-iron alloy, the cobalt-copper alloy wire is further superior in durability in terms of cyclic heat-cool operation.

Figure 2:
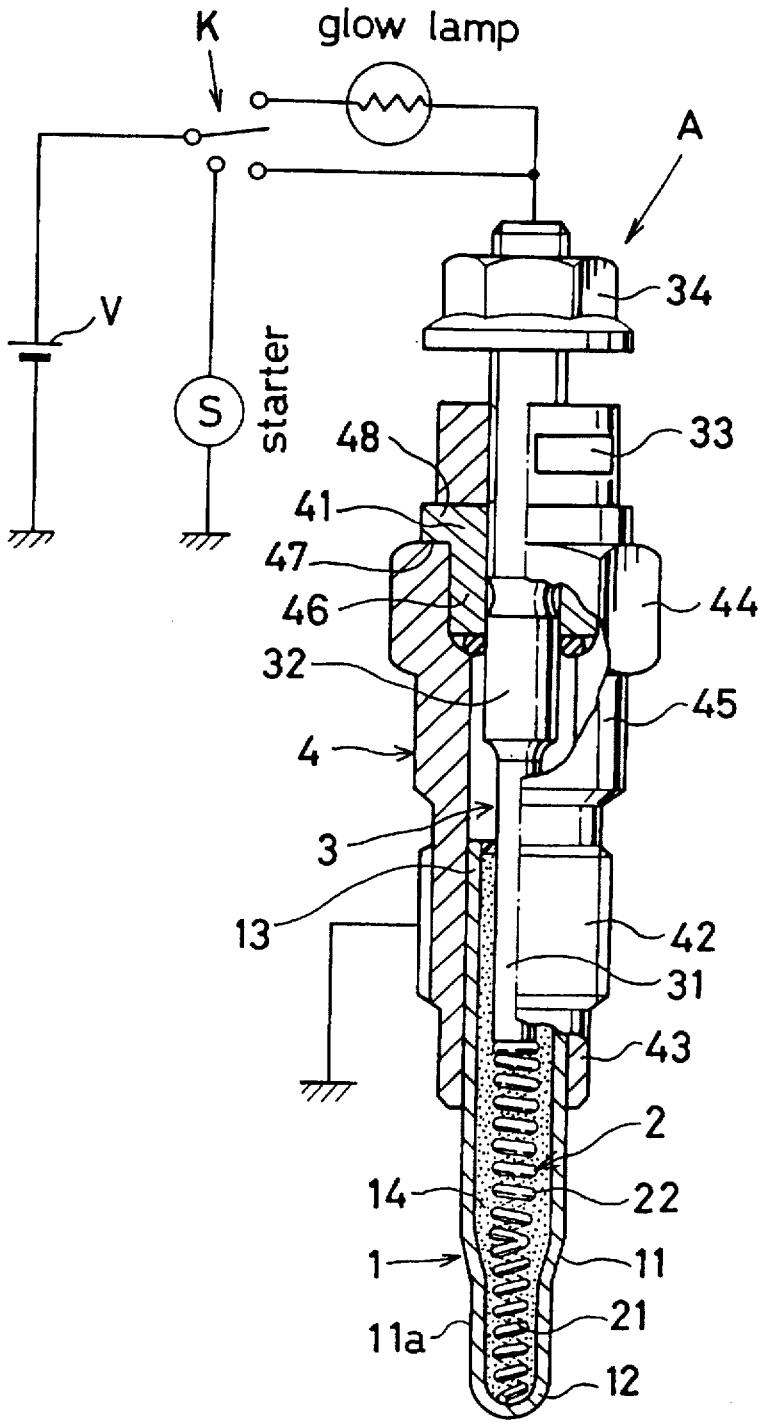
FIG. 2 is a partial cross sectional view of a temperature self-regulating type glow plug.

In FIG. 2 which shows a temperature self-regulating glow plug (A), a rear portion of the sheathed heater 1 is connected to a front portion 43 of a cylindrical metallic shell 4 by means of a silver soldering or press-fit. Into a rear portion 45 of the metallic shell 4, an insulator ring 41 is interfit to coaxially support the center electrode 3. The self-regulating glow plug (A) is to be energized by a battery cell or generator (V) by way of a key switch (K). The metallic shell 4, which serves as a ground electrode, has a diameter-reduced front portion 43 having a male thread 42 to mount the glow plug (A) on a cylinder head of an internal combustion engine. Further, the metallic shell 4 has the diameter-increased rear portion 45 whose rear end has a hexagonal rear portion 44.

The center electrode 3 has the diameter-reduced front portion 31 and a diameter-increased rear portion 32 whose outer surface is provided a male thread. To the rear portion 32 of the center electrode 3, nuts 33, 34 are screwed respectively. The former nut 33 fastens the insulator ring 41, and the latter nut 34 fixes a wire harness (not shown). The insulator ring 41 has a cylinder portion 46 interfit into the hexagonal portion 44 of the metallic shell 4, and at the same time having a flange 48 firmly interposed between the nut 33 and a rear end surface 47 of the metallic shell 4.

Figure 3:
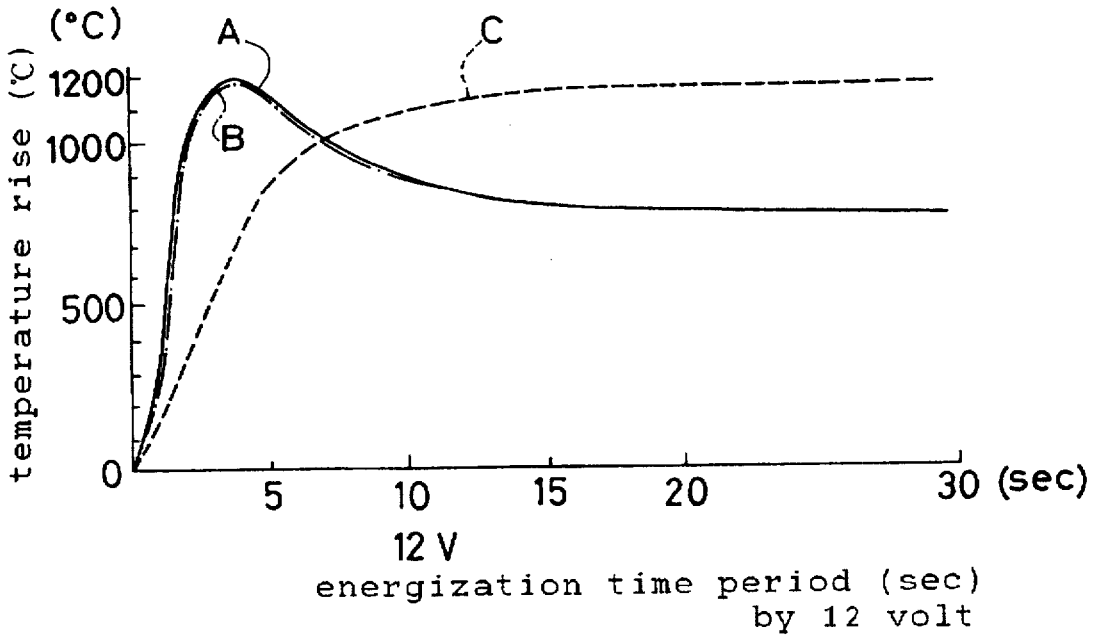
FIG. 3 is a graph showing a temperature rise characteristics.

FIG. 3 shows a graph illustrating a relationship between an energization time period (sec) and a temperature rise (°C). In the graph of FIG. 3, the self-regulating type glow plug (A) contains the copper component by 10% by weight. A first prior art counterpart (B) adopts a Co-8Fe alloy wire as a current regulation resistor. The Co-8Fe alloy means to contain 8% iron and 92% cobalt by weight as a balance.

A second prior art counterpart (C) adopts a Ni-plated pure iron wire as a current regulation resistor. The temperature rise of FIG. 3 represents an outer temperature of a diameter-reduced portion 11*a* of the sheathed tube 11 when each of the glow plugs was energized respectively by closing the key switch (K).

As apparent from FIG. 3, it was found that the glow plug (A) had as good a self-regulating function of the temperature as the first prior counterpart (B) since they exhibited a rapid resistance rise beyond 800° C. Although the second prior counterpart (C) exhibited a high temperature coefficient (approx. 11.5 fold at 900° C.), the counterpart (C) was poor in an instant temperature rising property since its temperature rise beyond 800° C. was gradually so as to take a long time to reach at 800° C., the temperature of which is necessary to insure a smooth start of the engine.

Figure 4:
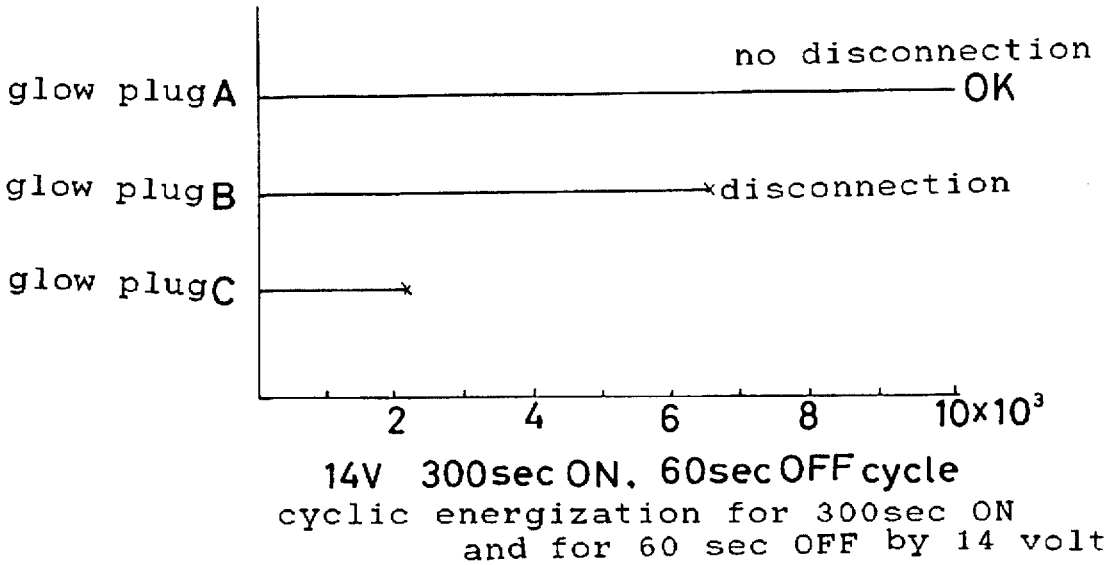
FIG. 4 is a graph showing a durabity experimental test result.

FIG. 4 shows an experimental test result of a disconnection resistant property on the glow plugs (A), (B) and (C). Each of the glow plugs (A), (B) and (C) was cyclically energized (14 volt) for 300 seconds and deenergized for 60 seconds alternately. It was found that the glow plug (A) exhibited no disconnection when the on-off energization exceeded 10,000 cycles. While on the other hand, the glow plug (B) exhibited a disconnection at 7,000 cycles, and the glow plug (C) exhibited a disconnection at 2,000 cycles.

Figure 5:
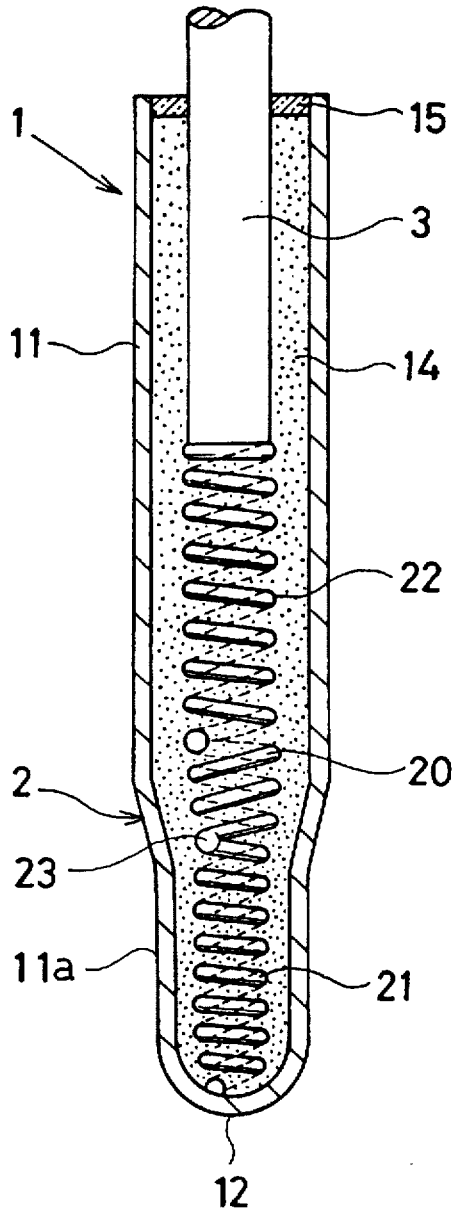
FIG. 5 is a longitudinal cross sectional view of a sheathed heater according to a second embodiment of the invention.

FIG. 5 shows a second embodiment of the invention in which a low value resistor 20 is connected between the heat resistor 21 and the current regulation resistor 22 so that the resistors 21, 22 are positioned remote each other. In the second embodiment of the invention, the low value resistor 20 thwarts a release of Joule's heat of the resistor 21 directly to the current regulation resistor 22 via the weld spot 23.

By way of illustration, an electrical resistance of the low value resistor 20 is smaller than a resistance (approx. 0.17 Ω) of the current regulation resistor 22 which is generally half a resistance (0.33 Ω) of the heat resistor 21. This means that the resistance ratio of the resistor 22 to the resistor 21 is predetermined substantially to be 1:2.

For this reason, it is possible to determine the resistance of the low value resistor 20 to be approximately 0.10 Ω.

With the provision of the low value resistor 20, it enables to a quick temperature rise of an outer surface of the sheathed tube 11 due to the Joule's heat of the resistor 21, and thus delaying the temperature rise of the current regulation resistor 22 to retard its current regulating function to reduce the after-glow heat generation so as to improve a durability of the glow plug. In this instance, the low value resistor 20 is made of nickel or nickel-chromium based alloy wire which is in the form of helix. On the other hand, a nickel-based alloy may be used to both the heat resistor 21 and the current regulation resistor 22 in order to be weld-intense against the low value resistor 20.

It is appreciated that instead of using to the glow plug, the sheathed heater 1 may be incorporated into a heating source for a toilet washer and a hand cleaning water to instantaneously heat a small batch of water.

It is also appreciated that the resistors 20, 21 and 22 may be appropriately deformed other than the helix. By way of examples, these resistors 20, 21 and 22 may be in the form of spiral, serpentine or meander.

While the invention has been described with reference to the specific embodiments, it is understood that this description is not to be construed in a limiting sense in as much as various modifications and additions to the specific embodiments may be made by skilled artisans without departing from the scope of the invention.

What is claimed is:

1. A sheathed heater comprising:

a heater disposed in a sheath tube to be connected in series with a heat resistor and a current regulation resistor;

an insulation powder loaded with the sheath tube to firmly support the heater;

the current regulation resistor being made from a cobalt-copper alloy which contains a copper component in the range from 1.0% to 14% by weight.

2. A temperature self-regulating type glow plug in which the sheathed heater as recited in claim 1 is incorporated into a front end of a metallic shell having a male thread to be mounted on a cylinder head of an internal combustion engine.

3. In temperature self-regulating type glow plug heater as recited in claim 2, wherein the heat resistor and the current regulation resistor are respectively in the form of helix.

4. In temperature self-regulating type glow plug heater as recited in claim 3, wherein a low value resistor is connected between the heat resistor and the current regulation resistor, an electrical resistance of the low value resistor being smaller than that of the current regulation resistor.

5. In a sheathed heater as recited in claim 1, wherein the heat resistor and the current regulation resistor are respectively in the form of helix.

6. In a sheathed heater as recited in claim 5, wherein a low value resistor is connected between the heat resistor and the current regulation resistor so as to delay its current regulating action by a limited period of time.

7. In a sheathed heater as recited in claim 5, wherein the low value resistor is made of nickel or nickel-chromium based alloy.

8. In a sheathed heater as recited in claim 1, wherein the current regulation resistor has an electrical resistance approximately half the heat resistor.

9. In a sheathed heater as recited in claim 8, wherein the current regulation resistor has an electrical resistance of approximately 0.17 Ω, and the heat resistor 0.33 Ω.

* * * * *